US007417605B2

(12) United States Patent
Kasai

(10) Patent No.: US 7,417,605 B2
(45) Date of Patent: Aug. 26, 2008

(54) ELECTRONIC CIRCUIT, ELECTRONIC DEVICE, AND ELECTRONIC APPARATUS

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 538 days.

(21) Appl. No.: 10/669,852

(22) Filed: Sep. 25, 2003

(65) Prior Publication Data

US 2007/0200802 A1 Aug. 30, 2007

(30) Foreign Application Priority Data

Sep. 26, 2002 (JP) ..... 2002-280918

(51) Int. Cl.
*G09G 3/30* (2006.01)
*G09G 3/10* (2006.01)

(52) U.S. Cl. ..... 345/76; 315/169.3

(58) Field of Classification Search ..... 345/76–82, 345/87, 204; 315/169.1–169.4
See application file for complete search history.

(56) References Cited

U.S. PATENT DOCUMENTS

| | | | | |
|---|---|---|---|---|
| 6,091,203 | A | 7/2000 | Kawashima et al. | |
| 6,462,722 | B1 | 10/2002 | Kimura et al. | |
| 6,501,466 | B1 * | 12/2002 | Yamagishi et al. | 345/204 |
| 6,791,129 | B2 | 9/2004 | Inukai | |
| 6,798,148 | B2 | 9/2004 | Inukai | |
| 6,809,706 | B2 * | 10/2004 | Shimoda | 345/55 |
| 6,876,350 | B2 * | 4/2005 | Koyama | 345/92 |
| 6,909,242 | B2 * | 6/2005 | Kimura | 315/169.3 |
| 6,924,602 | B2 * | 8/2005 | Komiya | 315/169.3 |
| 6,995,520 | B2 | 2/2006 | Inukai | |
| 2002/0047120 | A1 | 4/2002 | Inukai | |
| 2002/0196212 | A1 * | 12/2002 | Nishitoba et al. | 345/76 |
| 2004/0227707 | A1 | 11/2004 | Inukai | |
| 2005/0200300 | A1 * | 9/2005 | Yumoto | 315/169.1 |

FOREIGN PATENT DOCUMENTS

| | | |
|---|---|---|
| CN | 1322015 A | 11/2001 |
| JP | A-11-282419 | 10/1999 |
| JP | A-2003-255896 | 9/2003 |
| WO | WO 98/36406 | 8/1998 |
| WO | WO 01-06484 A1 | 1/2001 |

* cited by examiner

*Primary Examiner*—Amr Awad
*Assistant Examiner*—Stephen G Sherman
(74) *Attorney, Agent, or Firm*—Oliff & Berridge, PLC

(57) ABSTRACT

To provide an electronic circuit, an electronic device, and an electronic apparatus, which are suitable for shortening data writing time or decreasing power consumption five driving transistors having the same gain factor are connected in series to form a driving current generation circuit unit. Further, five current supply transistors having the same gain factor are connected in parallel to form a current supply circuit unit. Also, gates of the driving transistors are connected to gates of the current supply transistors, respectively. Further, the current supply circuit unit is electrically connected to a data line Xm for supplying data current Idatam. Furthermore, driving current Ie1 generated in the driving current generation circuit unit is supplied to organic EL elements.

20 Claims, 9 Drawing Sheets

ELECTRONIC CIRCUIT, ELECTRONIC DEVICE, AND ELECTRONIC APPARATUS

BACKGROUND OF THE INVENTION

1. Field of Invention

The present invention relates to an electronic circuit, an electronic device, and an electronic apparatus.

2. Description of Related Art

In recent years, electro-optical devices using electro-optical elements such as organic EL (electroluminescent) elements have received attention. Since the organic EL elements are self-luminous elements, and thus do not require a backlight, it is possible to realize an electro-optical device having low power consumption, a wide angle of view and high contrast ratio.

Among such kinds of electro-optical devices, in an electro-optical device referred to as an "active matrix electro-optical device," pixel circuits for controlling driving current supplied to the organic EL elements are provided in a display panel unit thereof.

The pixel circuits include capacitors for storing a quantity of electric charge corresponding to data signals and transistors for controlling the driving current in accordance with the quantity of electric charge in the capacitors. See International Publication Pamphlet No. WO98/36406.

SUMMARY OF THE INVENTION

However, in particular, in the pixel circuits including current-driven elements, such as organic EL elements as electro-optical elements, since unevenness in the characteristics of the transistors may directly affect the brightness of the electro-optical elements, it is necessary to suppress the unevenness in the characteristics of the transistors.

Therefore, the present invention provides an electronic circuit, an electronic device, and an electronic apparatus which are capable of suppressing the unevenness in the characteristics of transistors.

Further, for example, when current signals are used as data signals, in particular, time of writing data to the pixel circuits is lengthened, or power consumption is increased. Therefore, the present invention provides an electronic circuit, an electronic device, and an electronic apparatus which are suitable for shortening the data writing time or decreasing the power consumption when current signals are used as the data signals.

An electronic circuit according to the present invention includes: a first circuit unit through which a first current having a first current level passes; a capacitor element to store a quantity of electric charge corresponding to the first current level; and a second circuit unit to generate a second current, having a second current level different from the first current level, on the basis of the quantity of electric charge stored in the capacitor element, at least one of the first circuit unit and the second circuit unit including unit elements connected in series or in parallel.

According to the above construction, since the writing of data signals to the capacitor element can be carried out by means of the current signals, it is possible to suppress the unevenness in the characteristics of the unit elements. Furthermore, by connecting the unit elements in series or in parallel, it is possible to provide an electronic circuit capable of generating current, having a current level different from the current level of the inputted current, while suppressing an enlargement of the area occupied by constituent transistors.

An electronic circuit according to the present invention includes: a first circuit unit through which a first current having a first current level passes; a capacitor element to store a quantity of electric charge corresponding to the first current level; and a second circuit unit to generate a second current, having a second current level different from the first current level, on the basis of the quantity of electric charge stored in the capacitor element, the first circuit unit including a plurality of unit elements connected in parallel.

According to the above construction, since the writing of data signals to the capacitor element can be carried out by means of the current signals, it is possible to suppress the unevenness in the characteristics of the unit elements. Furthermore, by connecting the unit elements of the first circuit unit in parallel, it is possible to provide an electronic circuit capable of generating current, having a current level different from the current level of the inputted current, while suppressing an enlargement of the area occupied by constituent transistors.

An electronic circuit according to the present invention includes: a first circuit unit through which a first current having a first current level passes; a capacitor element to store a quantity of electric charge corresponding to the first current level; and a second circuit unit to generate a second current, having a second current level different from the first current level, on the basis of the quantity of electric charge stored in the capacitor element, the second circuit unit including a plurality of unit elements connected in series.

According to the above construction, since the writing of data signals to the capacitor element can be carried out by means of the current signals, it is possible to suppress the unevenness in the characteristics of the unit elements. Furthermore, by connecting the unit elements of the first circuit unit in series, it is possible to provide an electronic circuit capable of generating current, having a current level different from the current level of the inputted current, while suppressing an enlargement of the area occupied by constituent transistors.

An electronic circuit according to the present invention includes: a first circuit unit through which a first current having a first current level passes; a capacitor element to store a quantity of electric charge corresponding to the first current level; and a second circuit unit to generate a second current, having a second current level different from the first current level, on the basis of the quantity of electric charge stored in the capacitor element, the first circuit unit including a plurality of unit elements connected in parallel and the second circuit unit includes a plurality of unit elements connected in series.

According to the above construction, since the writing of data signals to the capacitor element can be carried out by means of the current signals, it is possible to suppress the unevenness in the characteristics of the unit elements. Furthermore, by connecting the unit elements of the first circuit unit in parallel and connecting the unit elements of the second circuit unit in series, it is possible to provide an electronic circuit capable of generating current, having a current level different from the current level of the inputted current, while suppressing an enlargement of the area occupied by constituent transistors.

An electronic circuit according to the present invention includes: a first circuit unit through which a first current having a first current level passes; a capacitor element to store a quantity of electric charge corresponding to the first current level; and a second circuit unit to generate a second current having a second current level different from the first current level on the basis of the quantity of electric charge stored in the capacitor element, wherein at least one of the first circuit unit and the second circuit unit includes a plurality of unit elements connected in series or in parallel and the electrical connections of the plurality of unit elements are controlled by a control element.

According to the above construction, since the writing of data signals to the capacitor element can be carried out by means of the current signals, it is possible to suppress the unevenness in the characteristics of the unit elements. Furthermore, by using the number of unit elements constituting the first circuit unit and the second circuit unit in combination, it is possible to provide an electronic circuit capable of generating current, having a current level different from the current level of the inputted current, while suppressing an enlargement of the area occupied by constituent transistors.

In the above electronic circuit, at least one of the plurality of unit elements is a unit element common to the first circuit unit and the second circuit unit.

According to this construction, a current mirror circuit can be constructed from the first circuit unit and the second circuit unit.

In the above electronic circuit, the plurality of unit elements have the same driving capability.

According to this construction, it is possible to enhance the mirror characteristic of the current mirror circuit.

In this electronic circuit, the plurality of unit elements are formed in a bundle.

According to this construction, the electronic circuit including the first circuit unit and the second circuit unit can be easily constructed.

In the above electronic circuit, the first current level is higher than the second current level.

According to this construction, the first current can be written to the capacitor element at a high speed.

In this electronic circuit, the second current level is higher than the first current level.

According to this construction, the current level of the first current can be amplified.

The above electronic circuit may include electronic elements supplied with the second current.

According to this construction, it is possible to provide an electronic circuit having the electronic elements that are driven on the basis of a current level different from the current level of the inputted current while suppressing an enlargement of the area occupied by constituent transistors.

In this electronic circuit, the electronic elements may be electro-optical elements or current-driven elements.

According to this construction, it is possible to provide an electronic circuit having the electro-optical elements or the current-driven elements that are driven on the basis of a current level, different from the current level of the inputted current, while suppressing an enlargement of the area occupied by constituent transistors.

In the above electronic circuit, the electronic elements may be organic EL elements.

According to the above construction, it is possible to provide an electronic circuit having the organic EL elements that are driven on the basis of a current level, different from the current level of the inputted current, while suppressing an enlargement of the area occupied by constituent transistors.

An electronic device according to the present invention is provided with a first signal line, a second signal line, and a plurality of unit circuits, each of the plurality of unit circuits including: a switching element connected to the first signal line, wherein an on/off state of the switching element is controlled by switching signals supplied from the first signal line; a first circuit unit connected to the second signal line, a first current having a first current level supplied from the second signal line passing through the first circuit unit by switching on the switching element; a capacitor element to store a quantity of electric charge corresponding to the first current level; and a second circuit unit to generate a second current having a second current level, different from the first current level, on the basis of the quantity of electric charge stored in the capacitor element, at least one of the first circuit unit and the second circuit unit including unit elements connected in series or in parallel.

According to the above construction, since the writing of data signals to the capacitor element can be carried out by current signals, it is possible to suppress the unevenness in the characteristics of the unit elements. Furthermore, by connecting the unit elements in series or in parallel, it is possible to provide an electronic device capable of generating current having a current level, different from the current level of the inputted current, while suppressing an enlargement of the area occupied by constituent transistors.

An electronic device according to the present invention is provided with a first signal line, a second signal line, and a plurality of unit circuits, each of the plurality of unit circuits including: a switching element connected to the first signal line, an on/off state of the switching element being controlled by switching signals supplied from the first signal line; a first circuit unit connected to the second signal line, a first current having a first current level supplied from the second signal line passing through the first circuit unit by switching on the switching element; a capacitor element to store a quantity of electric charge corresponding to the first current level; and a second circuit unit to generate a second current having a second current level different from the first current level on the basis of the quantity of electric charge stored in the capacitor element, wherein the first circuit unit includes a plurality of unit elements connected in parallel.

According to the above construction, since the writing of data signals to the capacitor element can be carried out by current signals, it is possible to suppress the unevenness in the characteristics of the unit elements. Furthermore, by connecting the unit elements of the first circuit unit in parallel, it is possible to provide an electronic device capable of generating current, having a current level different from the current level of the inputted current, while suppressing an enlargement of the area occupied by constituent transistors.

An electronic device according to the present invention is provided with a first signal line, a second signal line, and a plurality of unit circuits, each of the plurality of unit circuits including: a switching element connected to the first signal line, wherein an on/off state of the switching element is controlled by switching signals supplied from the first signal line; a first circuit unit connected to the second signal line, a first current having a first current level supplied from the second signal line passing through the first circuit unit by switching on the switching element; a capacitor element to store a quantity of electric charge corresponding to the first current level; and a second circuit unit to generate a second current having a second current level, different from the first current level, on the basis of the quantity of electric charge stored in the capacitor element, the second circuit unit including a plurality of unit elements connected in series.

According to the above construction, since the writing of data signals to the capacitor element can be carried out by current signals, it is possible to suppress the unevenness in the characteristics of the unit elements. Furthermore, by connecting the unit elements of the first circuit unit in series, it is possible to provide an electronic device capable of generating current, having a current level different from the current level of the inputted current, while suppressing an enlargement of the area occupied by constituent transistors.

An electronic device according to the present invention is provided with a first signal line, a second signal line, and a plurality of unit circuits, each of the plurality of unit circuits including: a switching element connected to the first signal line, wherein an on/off state of the switching element is controlled by switching signals supplied from the first signal line; a first circuit unit connected to the second signal line, a first current having a first current level supplied from the second signal line passing through the first circuit unit by switching on the switching element; a capacitor element to store a quantity of electric charge corresponding to the first current level; and a second circuit unit to generate a second current, having a second current level different from the first current level, on the basis of the quantity of electric charge stored in the capacitor element, the first circuit unit comprising a plurality of unit elements connected in parallel and the second circuit unit including a plurality of unit elements connected in series.

According to the above construction, since the writing of data signals to the capacitor element can be carried out by means of the current signals, it is possible to suppress the unevenness in the characteristics of the unit elements. Furthermore, by connecting the unit elements of the first circuit unit in parallel and connecting the unit elements of the second circuit unit in series, it is possible to provide an electronic device capable of generating current, having a current level different from the current level of the inputted current, while suppressing an enlargement of the area occupied by constituent transistors.

An electronic device according to the present invention is provided with a first signal line, a second signal line, and a plurality of unit circuits, each of the plurality of unit circuits including: a switching element connected to the first signal line, wherein an on/off state of the switching element is controlled by switching signals supplied from the first signal line; a first circuit unit connected to the second signal line, a first current having a first current level supplied from the second signal line passing through the first circuit unit by switching on the switching element; a capacitor element to store a quantity of electric charge corresponding to the first current level; and a second circuit unit to generate a second current having a second current level, different from the first current level, on the basis of the quantity of electric charge stored in the capacitor element, at least one of the first circuit unit and the second circuit unit including a plurality of unit elements connected in series or in parallel and the electrical connections of the plurality of unit elements being controlled by a control element.

According to the above construction, since the writing of data signals to the capacitor element can be carried out by means of the current signals, it is possible to suppress the unevenness in the characteristics of the unit elements. Furthermore, by using the number of unit elements constituting the first circuit unit and the second circuit unit in combination, it is possible to provide an electronic device capable of generating current, having a current level different from the current level of the inputted current, while suppressing an enlargement of the area occupied by constituent transistors.

In the above electronic device, at least one of the plurality of unit elements may be a unit element common to the first circuit unit and the second circuit unit.

According to the above construction, a current mirror circuit can be constructed from the first circuit unit and the second circuit unit.

In the above electronic device, the plurality of unit elements have the same driving capability.

According to the above construction, it is possible to enhance the mirror characteristic of the current mirror circuit.

In the above electronic device, the plurality of unit elements may be formed in a bundle.

According to this construction, the electronic device including the first circuit unit and the second circuit unit can be easily constructed.

In the above electronic device, the first current level is higher than the second current level.

According to the above construction, the first current can be written to the capacitor element at a high speed.

In the above electronic device, the second current level may be higher than the first current level.

According to the above construction, the current level of the first current can be amplified.

The above electronic device may include electronic elements supplied with the second current.

According to the above construction, it is possible to provide an electronic device having the electronic elements that are driven on the basis of a current level, different from the current level of the inputted current, while suppressing an enlargement of the area occupied by constituent transistors.

In the above electronic device, the electronic elements may be electro-optical elements or current-driven elements.

According to the above construction, it is possible to provide an electronic device having the electro-optical elements or the current-driven elements that are driven on the basis of a current level, different from the current level of the inputted current, while suppressing an enlargement of the area occupied by constituent transistors.

In the above electronic device, the electronic elements may be organic EL elements.

According to the above construction, it is possible to provide an electronic device having the organic EL elements that are driven on the basis of a current level, different from the current level of the inputted current, while suppressing an enlargement of the area occupied by constituent transistors.

An electronic apparatus according to the present invention has mounted thereon the aforementioned electronic circuit.

According to the above construction, it is possible to provide an electronic apparatus in which the unevenness in the characteristics of transistors is suppressed. Furthermore, by connecting the unit elements in series or in parallel, it is possible to provide an electronic apparatus including the electronic circuit capable of generating current having a current level, different from the current level of the inputted current, while suppressing an enlargement of the area occupied by constituent transistors.

An electronic apparatus according to the present invention has mounted thereon the aforementioned electronic device.

According to the above construction, it is possible to provide an electronic apparatus in which the unevenness in the characteristics of transistors is suppressed. Furthermore, by connecting the unit elements in series or in parallel, it is possible to provide an electronic apparatus including the electronic device capable of generating current, having a current level different from the current level of the inputted current, while suppressing an enlargement of the area occupied by constituent transistors.

DETAILED DESCRIPTION OF PREFERRED EMBODIMENTS

First Exemplary Embodiment

Figure 1:
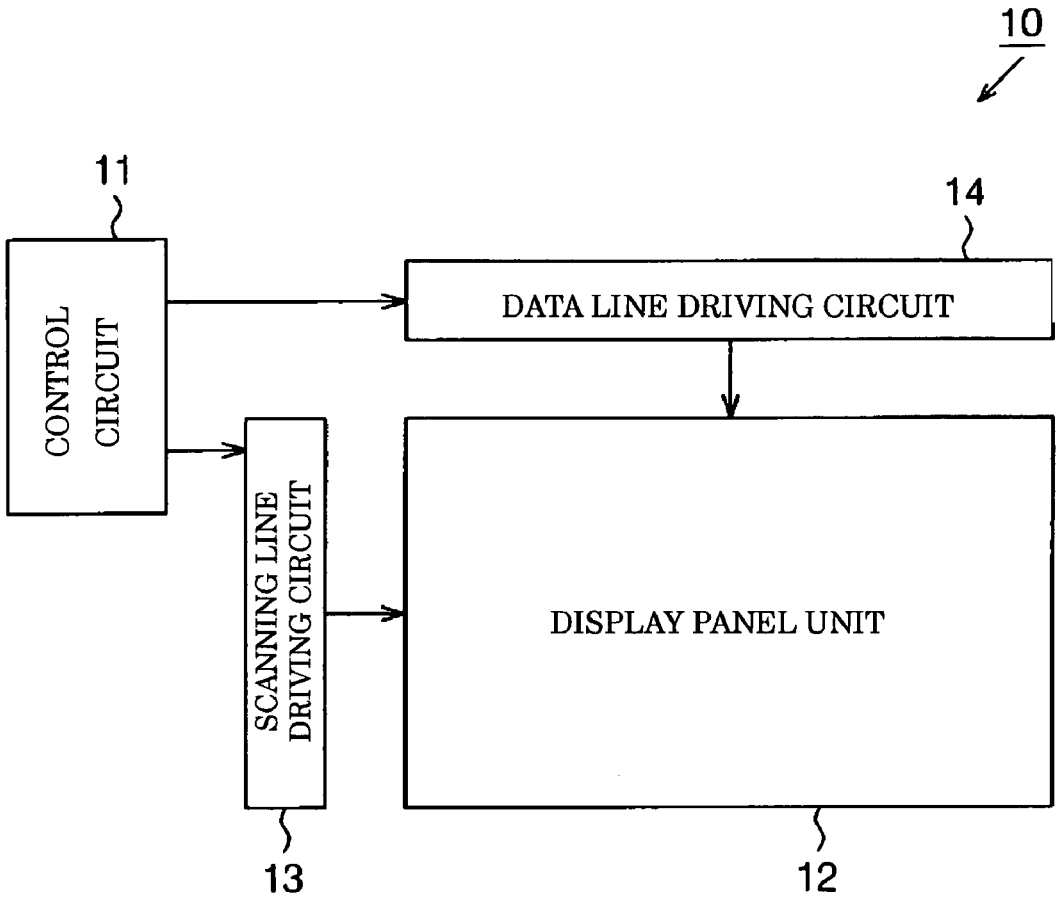
FIG. 1 is a circuitry block schematic illustrating a circuit configuration of an organic EL display device according to a first exemplary embodiment.
Figure 2:
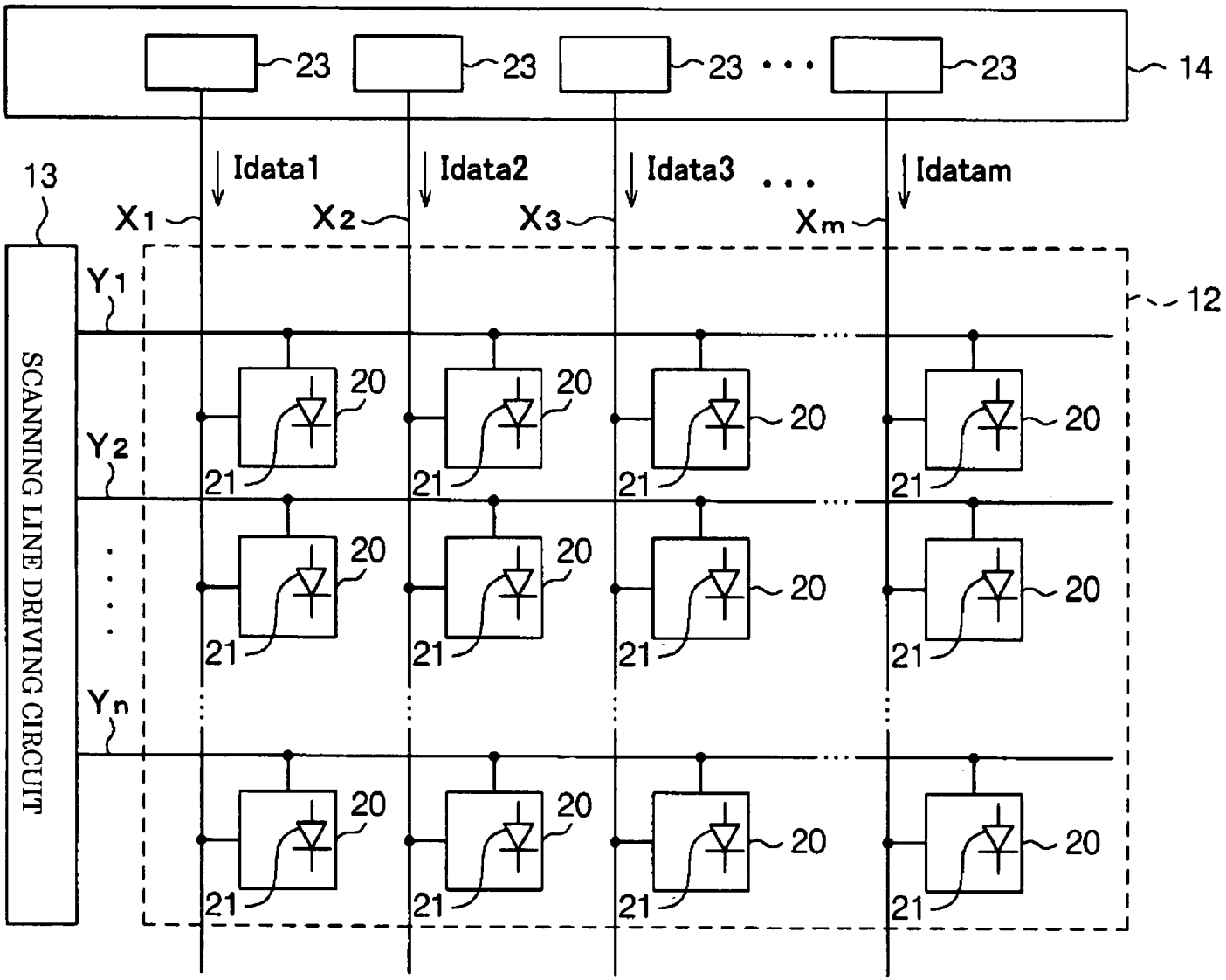
FIG. 2 is a circuitry block schematic illustrating an internal configuration of a display panel part and a data line driving circuit.
Figure 3:
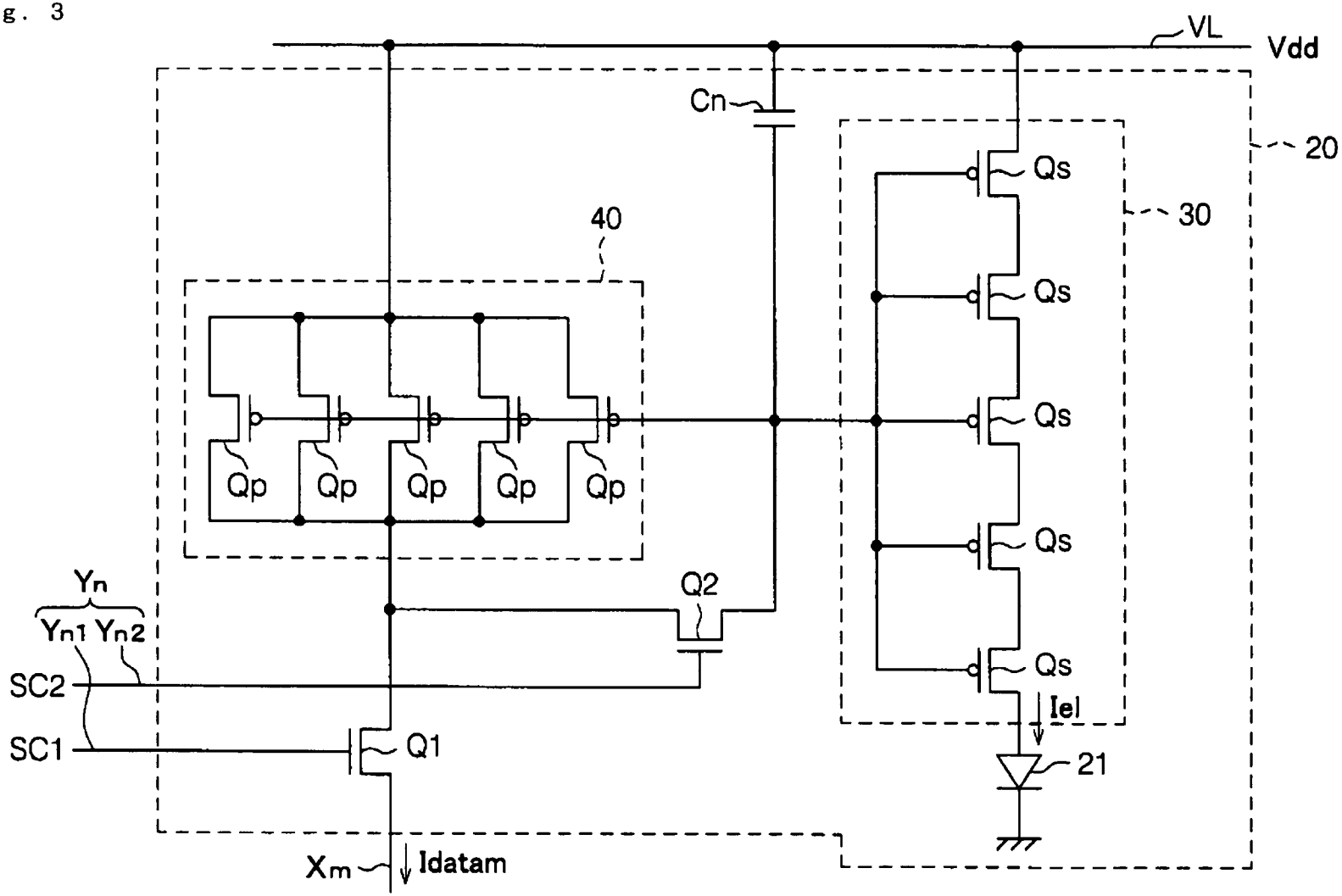
FIG. 3 is a circuit schematic of a pixel circuit for the purpose of explanation of the first exemplary embodiment.
Figure 4:
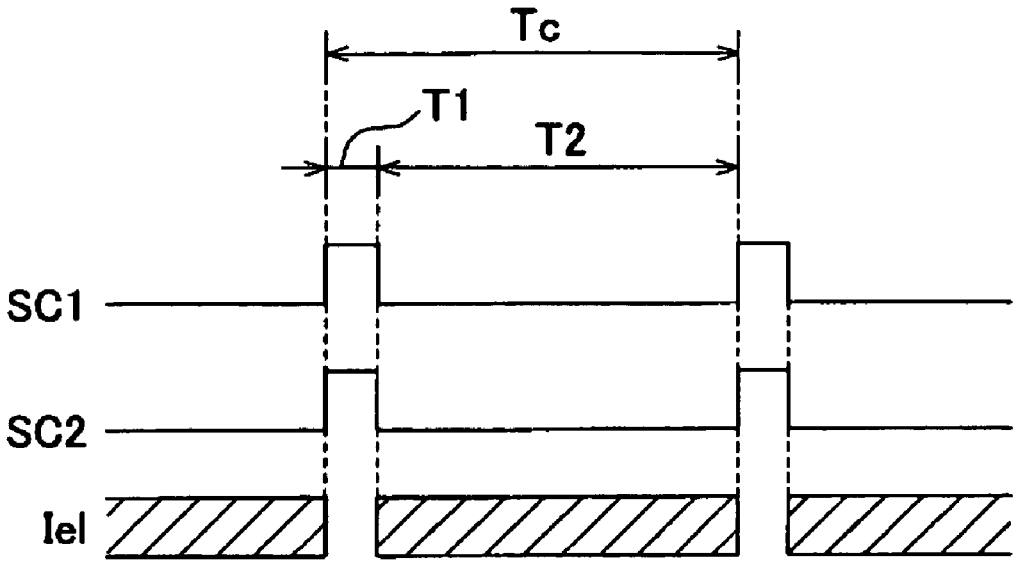
FIG. 4 is a timing chart for explaining the operation of the pixel circuit according to the first exemplary embodiment.

Now, a first exemplary embodiment of the present invention will be described with reference to FIGS. 1 to 4. FIG. 1 is a circuitry block schematic illustrating a circuit configuration of an organic EL display device as an electronic device. FIG. 2 is a circuitry block schematic illustrating an internal configuration of a display panel unit and a data line driving circuit. FIG. 3 is a circuit schematic of a pixel circuit. FIG. 4 is a timing chart illustrating the operation of the pixel circuit.

An organic EL display device 10 includes, as shown in FIG. 1, a control circuit 11, a display panel unit 12, a scanning line driving circuit 13, and a data line driving circuit 14.

The control circuit 11, the scanning line driving circuit 13, and the data line driving circuit 14 of the organic EL display device 10 may be constructed using an independent electronic component, respectively.

For example, the control circuit 11, the scanning line driving circuit 13, and the data line driving circuit 14 may be constructed using one chip semiconductor integrated circuit device, respectively.

Otherwise, all or some of the control circuit 11, the scanning line driving circuit 13, and the data line driving circuit 14 may be constructed using a programmable IC chip, and the functions thereof may be executed as software by programs written in the IC chip.

The control circuit 11 generates scanning control signals and data control signals for displaying desired images in the display panel unit 12 on the basis of image data outputted from an external device (not shown). Further, the control circuit 11 outputs the scanning control signals to the scanning line driving circuit 13, and outputs the data control signals to the data line driving circuit 14.

As shown in FIG. 2, pixel circuits 20 as a plurality of electronic circuits or a plurality of unit circuits having organic EL elements 21 as electronic elements or current-driven elements whose light emitting layers are made of organic materials are arranged in a matrix in the display panel unit 12. That is, the pixel circuits 20 are arranged at positions corresponding to the intersected portions of M data lines Xm (m=1 to M; m is an integer) extending in a column direction and N scanning lines Yn (n=1 to N; n is an integer) extending in a row direction. Further, in this exemplary embodiment, the organic EL elements 21 are organic EL elements, which properly emit light by a driving current Ie1 as a second current, having an intensity of about 1/25th of the intensity of data current Idata as first current, generated in the data line driving circuit 14. Furthermore, transistors, which will be described later disposed in the respective pixel circuits 20 comprise TFTs (Thin Film Transistor), respectively.

The scanning line driving circuit 13 selects one scanning line of the N scanning lines Yn provided in the display panel unit 12 on the basis of the scanning control signals outputted from the control circuit 11, and then outputs scanning signals to the selected scanning line.

The data line driving circuit 14 includes a plurality of single line drivers 23. Each of the single line drivers 23 is connected to the data line Xm provided in the display panel unit 12. Each of the single line drivers 23 generates data currents Idata1 to Idatam, respectively, on the basis of the data control signals outputted from the control circuit 11. Further, the single line drivers 23 supply the generated data currents Idata1 to Idatam, to the corresponding pixel circuits 20, through the corresponding data lines X1 to Xm, respectively. By setting up the internal states of the corresponding pixel circuits 20 in accordance with the data currents Idata1 to Idatam, respectively, the pixel circuits 20 control the driving currents Ie1 flowing in the organic EL elements 21 to control gray scales in the brightness of the corresponding organic EL elements 21, respectively.

The pixel circuits 20 of the organic EL display device 10 constructed like the above will be described below with reference to FIG. 3. On the other hand, since the circuit configurations of the respective pixel circuits 20 are the same, only the pixel circuit 20 arranged at the intersected portion of the m-th data line Xm and the n-th scanning line Yn will be described, for the purpose of convenience of explanation.

The pixel circuit 20 include five driving transistors Qs, five current supply transistors Qp, first and second switching transistors Q1, Q2, and a storage capacitor Cn. Further, the driving transistors Qs and the current supply transistors Qp, the first switching transistor Q1 and the storage capacitor Cn correspond to the unit elements, the switching element, and the capacitor element described in the claims, respectively. Further, conductive types of the driving transistors Qs and the current supply transistors Qp are p type (p channel), respectively. Furthermore, conductive types of the first and second switching transistors Q1, Q2 are n type (n channel), respectively.

The respective driving transistors Qs are transistors functioning as driving transistors whose gain factor as driving capability is set to be βs. The respective current supply transistors Qp are transistors functioning as switching elements whose gain factor as driving capability is set to be βp. Further, in this exemplary embodiment, the gain factor βs of the driving transistors Qs is set to be equal to the gain factor βp of the current supply transistors Qp.

The first and second switching transistors Q1, Q2 are transistors functioning as switching elements whose on/off state is controlled in accordance with the scanning signals supplied from the scanning line driving circuit 13.

The five driving transistors Qs are mutually connected in series. That is, drains of the respective driving transistor Qs are connected to sources of the driving transistor Qs arranged adjacent to the respective driving transistors Qs. Further, among the five driving transistors Qs, a driving transistor Qs whose source is not connected to the drain of the adjacent driving transistor Qs is connected to a power source line VL for supplying driving voltage Vdd. Furthermore, among the five driving transistors Qs, a driving transistor Qs whose drain is not connected to the source of the adjacent driving transistor Qs is connected to an anode of the organic EL element 21. A cathode of the organic EL element 21 is grounded.

Furthermore, the respective gates of the five driving transistors Qs connected in series are connected to the respective gates of the current supply transistors Qp in common. The five driving transistors Qs connected in series like the above constitute the driving current generation circuit unit 30 as a second circuit unit.

Furthermore, the storage capacitor Cn is connected between the mutually connected gates of the five driving transistors Qs constituting the driving current generation circuit unit 30 and the power source line VL.

The five current supply transistors Qp are mutually connected in parallel. That is, the respective sources, the respective gates, and the respective drains of the five current supply transistors Qp are mutually connected, respectively. Further, the respective drains of the current supply transistors Qp are mutually connected and they are connected to the power source line VL. The respective gates of the current supply transistors Qp are mutually connected and they are connected to the respective gates of the five driving transistors Qs constituting the driving current generation circuit unit 30.

Furthermore, the respective drains of the current supply transistors Qp are mutually connected and they are connected to the first switching transistor Q1. The source of the first switching transistor Q1 is connected to the data line Xm, which is electrically connected to the data line driving circuit 14. The gate of the first switching transistor Q1 is connected to a first sub-scanning line Yn1 as a first signal line, which is connected to the scanning line driving circuit 13. As described above, the five current supply transistors Qp, mutually connected in parallel, constitute the current supply circuit unit 40 as a first circuit unit. The driving current generation circuit unit 30 and the current supply circuit unit 40 constitute a current value converting device.

Furthermore, the second switching transistor Q2 is connected between the respective drains of the five current supply transistors Qp constituting the current supply circuit unit 40 and the respective gates of the current supply transistors Qp. The gate of the second switching transistor Q2 is connected to a second sub-scanning line Yn2 as a second signal line, which is electrically connected to the scanning line driving circuit 13. That is, by switching on the second switching transistor Q2, the five current supply transistors Qp constituting the current supply circuit unit 40 are connected to diodes, respectively. Then, by allowing the respective current supply transistors Qp to be connected to diodes, the respective current supply transistors Qp and the five driving transistors Qs constituting the driving current generation circuit unit 30 constitute a current mirror circuit through the storage capacitor Cn. Furthermore, the first and second sub-scanning lines Yn1, Yn2 constitute the scanning line Yn.

Now, the operation of the driving current generation circuit unit 30 and the current supply circuit unit 40 constructed like the above will be described.

In general, when a plurality of transistors, having the same gain factor are mutually connected in series, it is known that the resultant gain factor of the transistors connected in series is a value obtained by dividing the gain factor of the respective transistors by the number of connected transistors. That is, supposing that the number of transistors connected in series is n and the gain factor of the respective transistors is βs, the resultant gain factor βso of the transistors mutually connected in series is expressed as follows.

$$\beta so=\beta s/n$$

Therefore, the resultant gain factor βso of the driving current generation circuit unit 30 including the five driving transistors Qs having a gain factor of βs in this exemplary embodiment is expressed as follows.

$$\beta so=\beta s/5$$

Furthermore, when a plurality of transistors, having the same gain factor are mutually connected in parallel, it is known that the resultant gain factor of the transistors mutually connected in parallel is a value obtained by multiplying the gain factor of the respective transistors by the number of connected transistors. That is, supposing that the number of transistors connected in parallel is n and the gain factor of the respective transistors is βp, the resultant gain factor βpo of the transistors connected in parallel is expressed as follows.

$$\beta po=\beta p\cdot n$$

Therefore, the resultant gain factor βpo of the current supply circuit unit 40 including the five current supply transistors Qp having a gain factor of βp in this exemplary embodiment is expressed as follows.

$$\beta po=\beta p\cdot 5$$

Here, supposing that the respective resultant gain factors of the driving current generation circuit unit 30 and the current supply circuit unit 40 are denoted as βso and βpo, the relative ratio of the data current Idata and the driving current Ie1 is expressed as the following equation.

$$\text{Idata}:\text{Ie}1=\beta po:\beta so$$

Here, since the resultant gain factor βso of the driving current generation circuit unit 30 is βs/5 and the resultant gain factor βpo of the current supply circuit unit 40 is 5βp, the relative ratio of the data current Idata and the driving current Ie1 is expressed as follows.

$$Idata:Ie1=5\beta p:\beta s/5$$

Since the gain factor βp of the current supply transistors Qp is set to be equal to the gain factor βs of the driving transistors Qs as described above, the above equation is expressed as follows.

$$\begin{aligned} Idata : Iel &= \beta po : \beta so \\ &= 5 : 1/5 \end{aligned}$$

Therefore, the data current Idata is expressed as the following equation. Idata=25Ie1

Therefore, since the pixel circuits 20 of the present invention can be supplied with the data current Idata, having a current level twenty five times greater than the current level of the driving current Ie1, the first current level for the data current Idatam can be written into the storage capacitor Cn at a correspondingly higher speed. Furthermore, since the writing of data onto storage capacitor Cn is carried out using the data current Idata that is a current signal, it is possible to suppress the unevenness in the characteristics such as a threshold voltage of the driving transistors Qs for every pixel circuit 20.

Furthermore, since the driving transistors Qs and the current supply transistors Qp are formed to have the same gain factor, it is possible to enhance the accuracy in the mirror characteristic, compared with a case where the current mirror circuit is constructed using different gain factors.

Next, an occupied area of the overall transistors arranged in the pixel circuit 20 including the driving current generation circuit unit 30 and the current supply circuit unit 40 is calculated.

First, the occupied area S1 of the five driving transistors Qs constituting the driving current generation circuit unit 30 is calculated. In general, when the channel lengths of transistors are the same, it is known that the occupied area of the transistors is proportional to the gain factor. Since the gain factors βs of the respective driving transistors Qs are the same, if the respective occupied areas of the respective driving transistors Qs are denoted as SQs, the occupied area S1 of the driving current generation circuit unit 30 is expressed as follows.

$$S1=5SQs$$

Next, the occupied area S2 of the five current supply transistors Qp constituting the current supply circuit unit 40 is calculated. Since the gain factors βp of the respective current supply transistors Qp are the same, if the respective occupied areas of the respective current supply transistors Qp are SQp, the occupied area S2 of the five current supply transistors Qp is expressed as follows.

$$S2=5SQp$$

Therefore, if the occupied areas of the first and second switching transistors Q1, Q2 are SQ1 and SQ2, respectively, the occupied area St of the overall transistors provided in the pixel circuit 20 is expressed as follows.

$$St=5SQs+5SQp+SQ1+SQ2$$

Here, as described above, since the gain factor βs of the driving transistors Qs and the gain factor βp of the current supply transistors Qp are set to be equal to each other, the occupied area SQs of the driving transistors Qs and the occupied area SQp of the current supply transistors Qp are equal to each other. Further, the first and second switching transistors Q1, Q2 are transistors functioning as switching elements, as described above. Therefore, it is supposed that the occupied area SQ1 of the first switching transistor Q1 and the occupied area SQ2 of the second switching transistor Q2 are equal to each other, and supposed that the occupied areas SQ1, SQ2 are equal to the occupied areas SQ of the driving transistors Qs and the current supply transistors Qp. By doing so, if the occupied area of the driving transistors Qs is SQs, the occupied area St of the overall transistors in the pixel circuit 20 is expressed as follows.

$$\begin{aligned} St &= 5SQs + 5SQp + SQ1 + SQ2 \\ &= 12SQs \end{aligned}$$

Next, an occupied area Ao of the overall transistors in a pixel circuit in which the driving current generation circuit unit 30 includes one driving transistor Qs, the current supply circuit unit 40 includes one current supply transistor Qp, and other first and second switching transistors Q1, Q2 are arranged similarly to the pixel circuit 20 is calculated. In this regard, it is supposed that the gain factor of the current supply transistor Qp is twenty five times greater than the gain factor of the driving transistor Qs. By doing so, the data current Idata, having the same current level as the pixel circuit 20, can be supplied to the storage capacitor Cn.

By doing so, as described above, since the occupied area of transistors is directly proportional to the gain factor, the relationship between the occupied area SQp of the current supply transistor Qp and the occupied area SQs of the driving transistor Qs is expressed as follows.

$$SQp=25SQs$$

Therefore, the occupied area Ao is expressed as follows.

$$\begin{aligned} Ao &= SQp + SQs + SQ1 + SQ2 \\ &= 25SQs + SQs + SQ1 + SQ2 \\ &= 26SQs + SQ1 + SQ2 \end{aligned}$$

Here, similarly to the occupied area St of the overall transistors provided in the pixel circuit 20, it is supposed that the respective occupied areas SQ1 and SQ2 of the first and second switching transistors Q1, Q2 are equal to each other. Then, supposing that the respective areas SQ1 and SQ2 of the first and second switching transistors Q1, Q2 are equal to the occupied area SQs of the driving transistor Qs, the occupied area Ao is expressed as follows.

$$\begin{aligned} Ao &= 26SQs + SQ1 + SQ2 \\ &= 28SQs \end{aligned}$$

From the above result, compared with the pixel circuit in which the driving current generation circuit unit 30 includes one driving transistor Qs and the current supply circuit unit 40 includes one current supply transistor Qp, the pixel circuit 20 shown in FIG. 3 can be supplied with the same quantity of the data current Idata as the driving current Ie1 and the occupied area of transistors thereof can be reduced by about 60%. The reduction rate of the occupied area, So of the transistors, is increased with increase in the relative ratio of the data current Idata and the driving current Ie1. For this reason, the pixel circuit in which the driving current generation circuit unit 30 includes a plurality of driving transistors Qs and the current supply circuit unit 40 includes a plurality of current supply transistors Qp can have larger aperture ratio.

Next, a method of driving the pixel circuit 20 including the driving current generation circuit unit 30 and the current supply circuit unit 40 will be described with reference to FIG. 4. FIG. 4 is a timing chart of a first scanning signal SC1 and a second scanning signal SC2 as switching signals supplied to the first and second switching transistors Q1, Q2 and the driving current Ie1 flowing in the organic EL elements 21.

Further, in FIG. 4, Tc, T1 and T2 denote a driving cycle, a data-writing period, and a light-emitting period, respectively. The driving cycle Tc includes the data-writing period T1 and the light-emitting period T2. The driving cycle Tc means a cycle in which the gray scales in the brightness of the organic EL elements 21 is updated by one turn and is the same as a so-called frame cycle.

First, for a predetermined data-writing period T1, the first and second scanning signals SC1, SC2 for switching on the first and second switching transistors Q1, Q2 are supplied through the first and second sub-scanning lines Yn1, Yn2 from the scanning line driving circuit 13, respectively. When the first and second scanning signals SC1, SC2 for switching on the first and second switching transistors Q1, Q2 are supplied, the first and second switching transistors Q1, Q2 are switched on for the data-writing period T1, respectively. Accordingly, the data current Idatam is supplied to the pixel circuit 20 and the five current supply transistors Qp, constituting the current supply circuit unit 40, are connected to diodes. Then, the current supply transistors Qp and the five driving transistors Qs, constituting the driving current generation circuit unit 30, are electrically connected one another to construct the current mirror circuit. By doing so, the data current Idatam passes through the current supply circuit unit 40, and a quantity of electric charge corresponding to the current level of the data current Idatam as the first current level is stored in the storage capacitor Cn. As a result, the voltage corresponding to the quantity of electric charge stored in the storage capacitor Cn is applied between the respective gates/sources of the five driving transistors Qs constituting the driving current generation circuit unit 30.

Next, for a predetermined light-emitting period T2 after the data-writing period T1, the first and second scanning signals SC1, SC2 for switching off the first and second switching transistors Q1, Q2 are supplied through the first and second sub-scanning lines Yn1, Yn2 from the scanning line driving circuit 13, respectively. When the first and second scanning signals SC1, SC2 for switching off the first and second switching transistors Q1, Q2 are supplied, the first and second switching transistors Q1, Q2 are switched off for the light-emitting period T2. Accordingly, the voltage corresponding to the quantity of electric charge stored in the storage capacitor Cn is applied between the respective gates/sources of the five driving transistors Qs constituting the driving current generation circuit unit 30. Then, the respective driving transistors Qs generate the driving current Ie1 having intensity based on the voltage corresponding to the quantity of electric charge stored in the storage capacitor Cn. At that time, the current level of the driving current Ie1 generated in the driving current generation circuit unit 30 is changed into ½5th of the data current Idata.

Further, although it is preferable that the first and second switching transistors Q1, Q2 be switched on for the data-writing period T1 and switched off for the light-emitting period T2, they are not limited thereto.

(1) In this exemplary embodiment like the above, the driving current generation circuit unit 30 is constructed by connecting in series the five driving transistors Qs having the same gain factor βs. Further, the current supply circuit unit 40 is constructed by connecting in parallel the five current supply transistors Qp having the same gain factor Op. Also, by connecting the respective gates of the driving transistors Qs constituting the driving current generation circuit unit 30 and the respective gates of the current supply transistors Qp constituting the current supply circuit unit 40, the driving transistors Qs and the current supply transistors Qp constitute the current mirror circuit. Furthermore, the respective gates of the driving transistors Qs are connected to the storage capacitor Cn for storing a quantity of electric charge corresponding to the data current Idata. Furthermore, the current supply circuit unit 40 is electrically connected to the data line Xm for supplying the data current Idata. Furthermore, the driving current Ie1 generated in the driving current generation circuit unit 30 is supplied to the organic El elements 21.

Accordingly, the current level of the data current Idata can be set to be twenty five times greater than the driving current Ie1. Therefore, the data current Idata can be written to the storage capacitor Cn at a correspondingly higher speed. Furthermore, since the writing of data to the storage capacitor Cn is carried out using the data current Idata which is a current signal, it is possible to suppress the unevenness in characteristics such as a threshold voltage of the driving transistors Qs for every pixel circuit 20.

(2) Further, in this exemplary embodiment, the current mirror circuit is constructed using the method of connecting in parallel and in series the transistors having a predetermined gain factor, that is, using a method of combining unit elements. By doing so, compared with a case where transistors having different gain factors constitute the current mirror circuit, it is possible to improve the accuracy in the mirror characteristics.

(3) Further, in this exemplary embodiment, the driving current generation circuit unit 30 is constructed by connecting in series the five driving transistors Qs having the same gain factor βs. Furthermore, the current supply circuit unit 40 is constructed by connecting in parallel the five current supply transistors Qp having the same gain factor βp. Accordingly, it is possible to provide a pixel circuit capable of suppressing deterioration of the aperture ratio, while supplying the data current Idata having the current level twenty five times greater than the driving current Ie1.

Second Exemplary Embodiment

Next, a second exemplary embodiment according to the present invention will be described with reference to FIGS. 5 to 8. Further, in this exemplary embodiment, like reference numerals denote elements similar to those of the first exemplary embodiment, and the detailed description thereof will be omitted.

Figure 5:
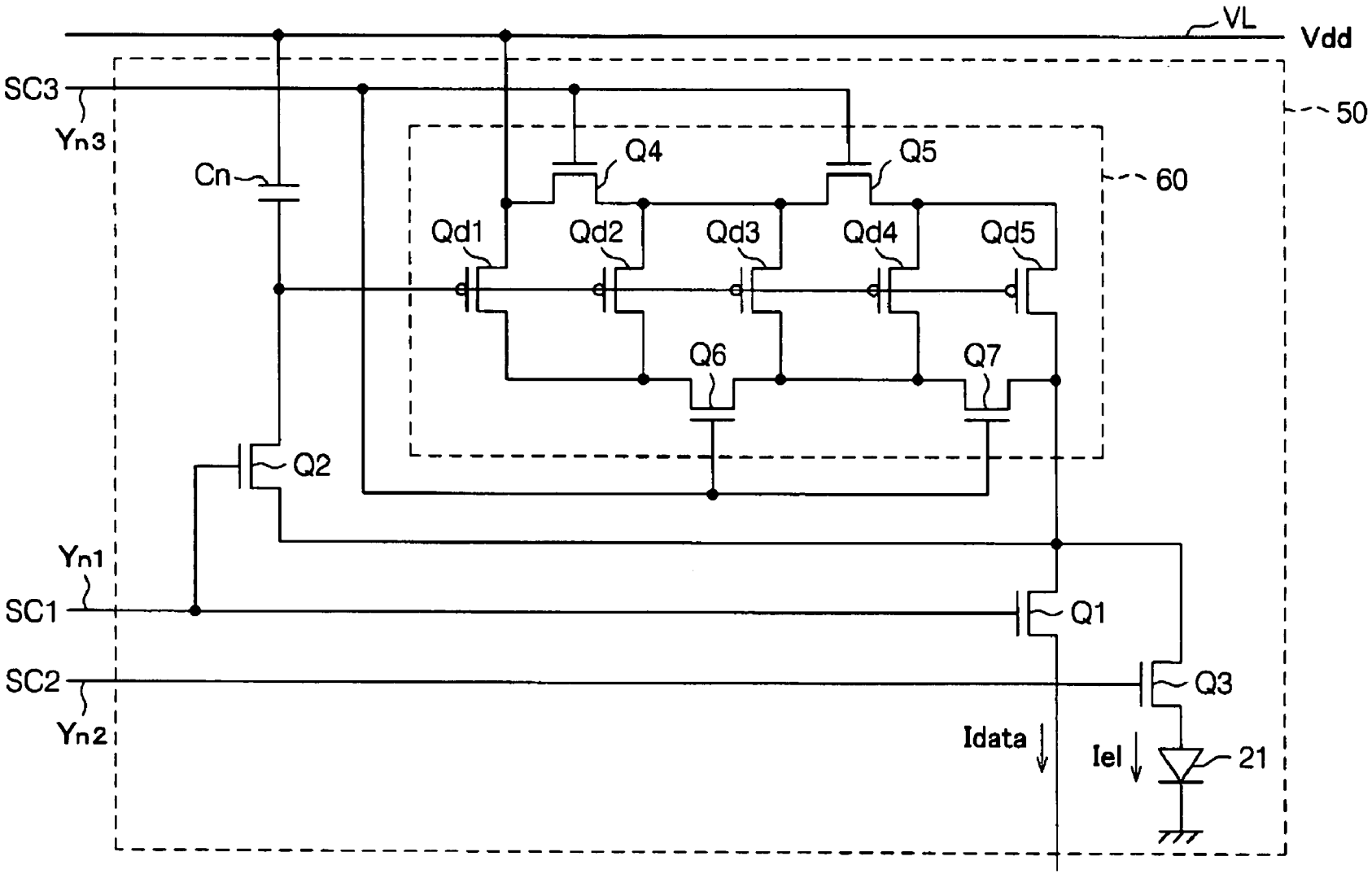
FIG. 5 is a circuit schematic of a pixel circuit for the purpose of explanation of a second exemplary embodiment.
Figure 6:
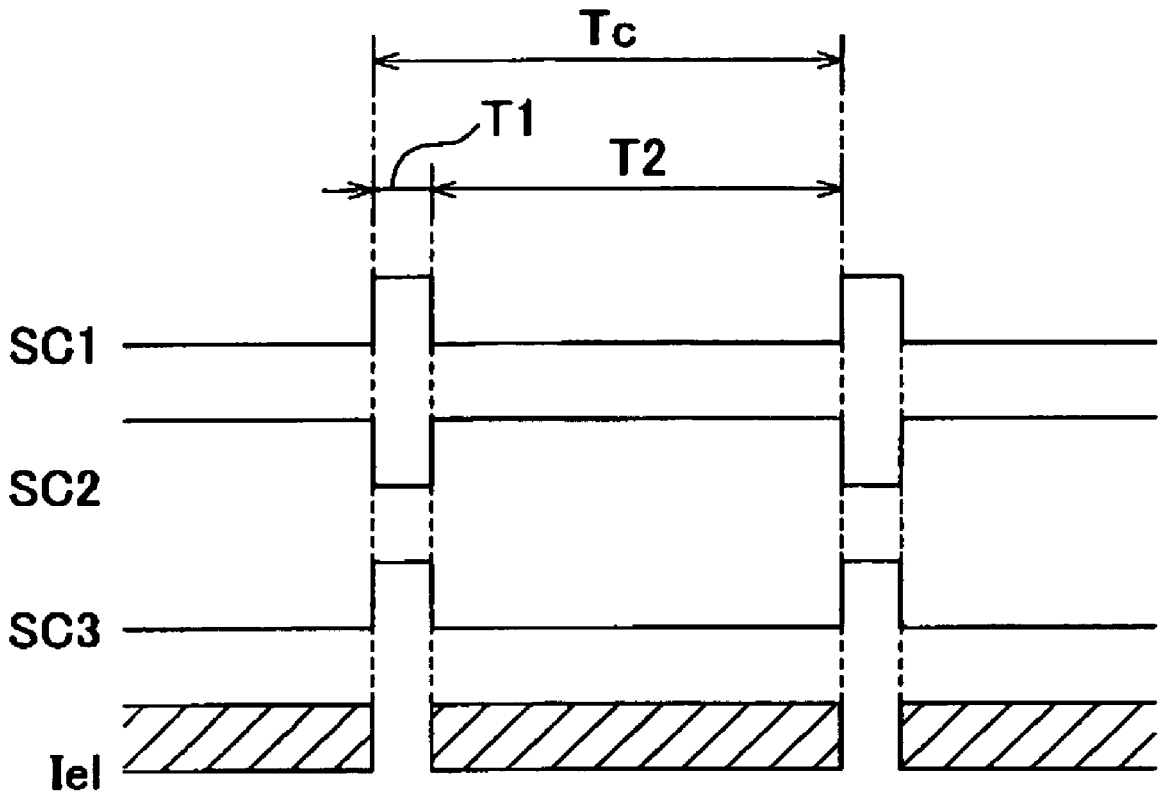
FIG. 6 is a timing chart for explaining the operation of the pixel circuit according to the second exemplary embodiment.
Figure 7:
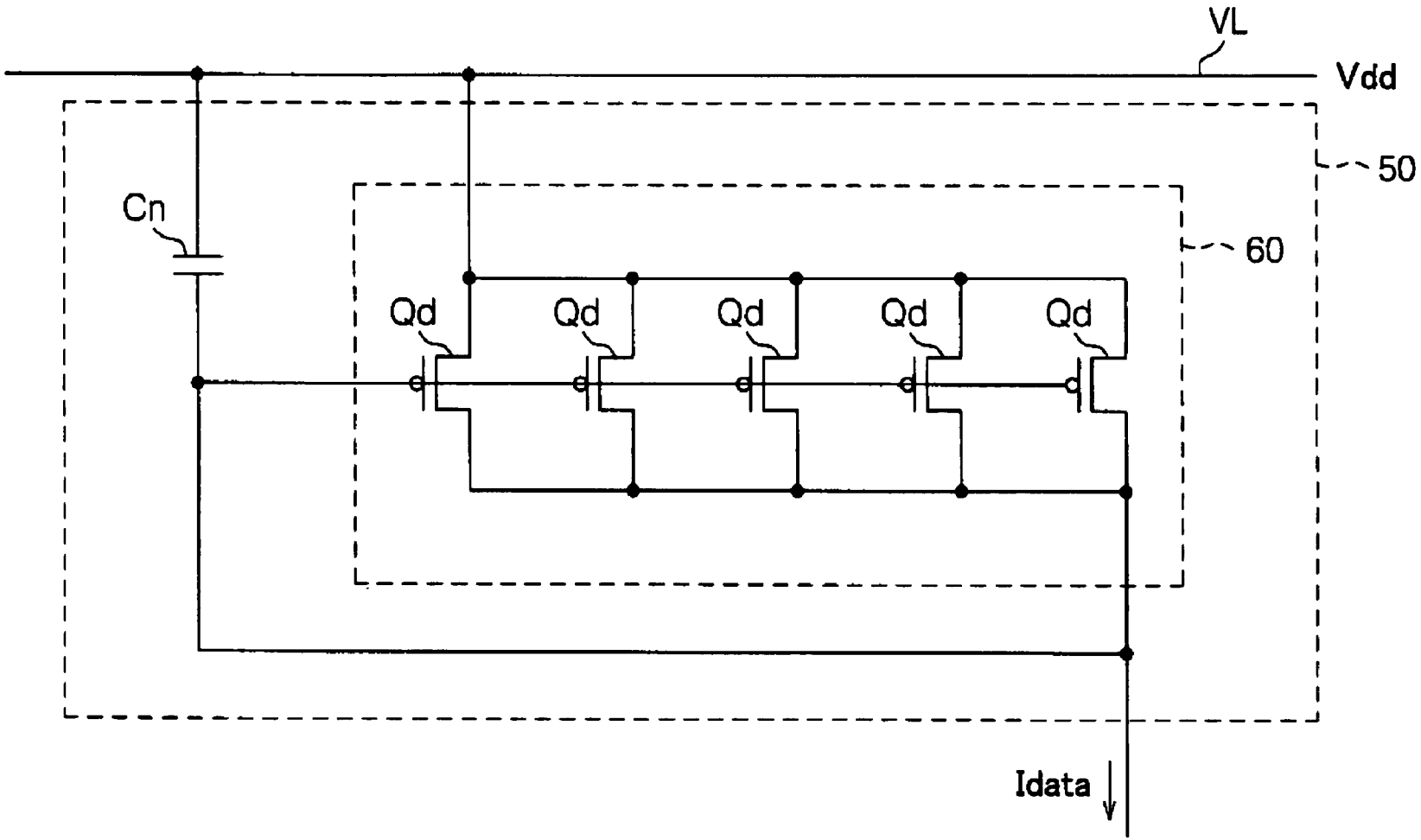
FIG. 7 is an equivalent circuit schematic of the pixel circuit for the purpose of explanation of the second exemplary embodiment.
Figure 8:
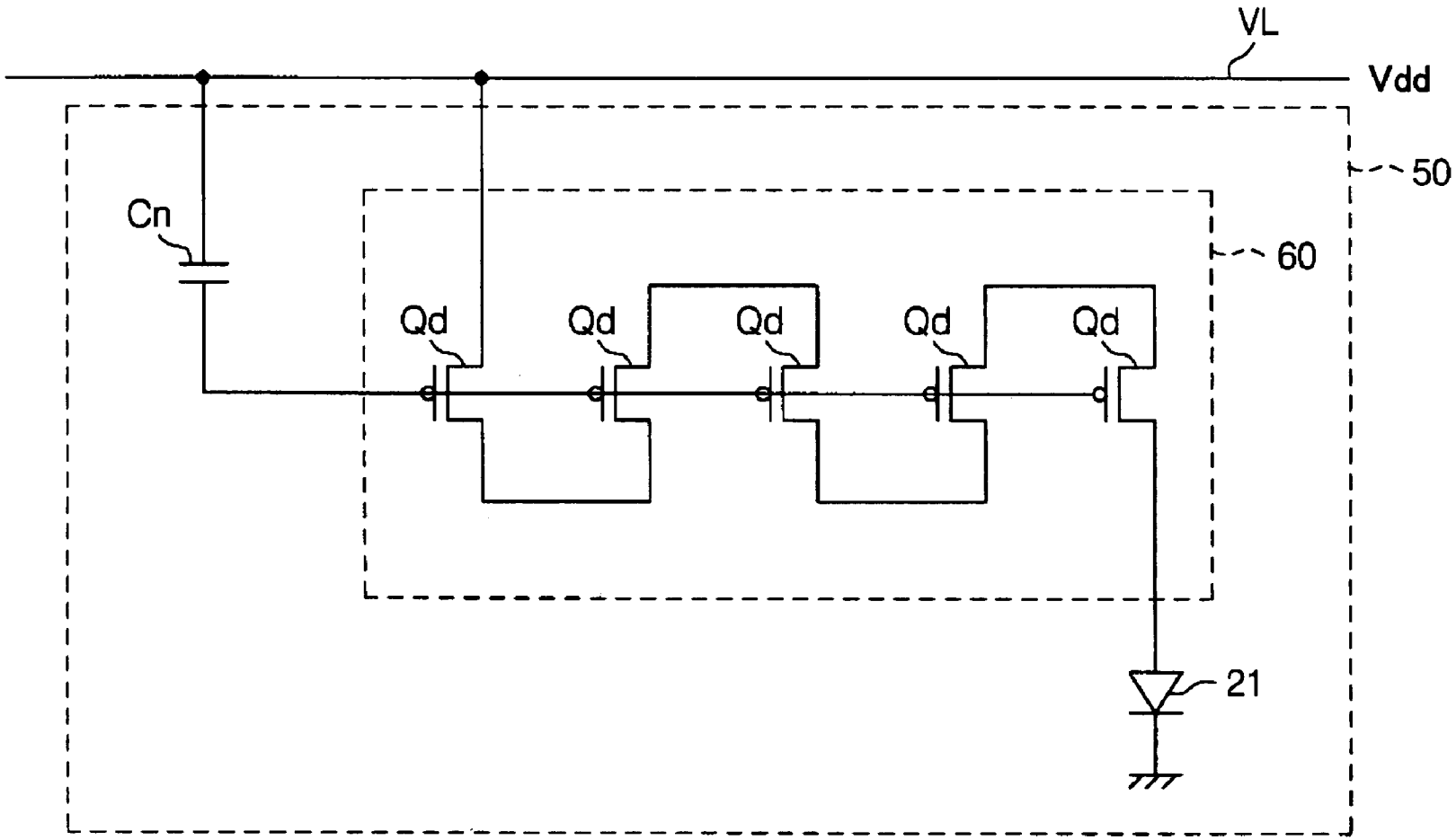
FIG. 8 is an equivalent circuit schematic of the pixel circuit for the purpose of explanation of the second exemplary embodiment.

FIG. 5 is a circuit schematic of a pixel circuit 50 provided in the display panel unit 12 of the organic EL display device 10. FIG. 6 is a timing chart illustrating the operation of the pixel circuit. FIGS. 7 and 8 are equivalent circuit schematics of the pixel circuit 50, respectively.

The pixel circuit 50 includes a current control circuit unit 60 combining the operation of the driving current generation circuit unit 30 with the current supply circuit unit 40 described in the first exemplary embodiment. Specifically, the pixel circuit 50 includes five transistors Qd1 to Qd5 functioning as driving transistors, first to seventh switching transistors Q1 to Q7 functioning as switching elements, a storage capacitor Cn, and an organic El element 21. Further, the fourth to seventh switching transistors Q4 to Q7 of the first to seventh switching transistors Q1 to Q7 correspond to the control element recited in the Claims.

Conductive types of the first to fifth transistors Qd1 to Qd5 are all p type (p channel). Further, conductive types of the first to seventh switching transistors Q1 to Q7 are all n type (n channel). The first to fifth transistors Qd1 to Qd5 are set to have the same gain factor βd. The on/off state of the first to seventh switching transistors Q1 to Q7 are controlled in accordance with the scanning signals supplied from the scanning line driving circuit 13, respectively.

The source of the first transistor Qd1, among the first to fifth transistors Qd1 to Qd5, is connected to the power source line VL for supplying the driving voltage Vdd. The drain of the first transistor Qd1 is connected to one electrode of the source and the drain of the second transistor Qd2. The source of the first transistor Qd1 is connected through the fourth switching transistor Q4 to the electrode of the second transistor Qd2, which are not connected to the drain of the first transistor Qd1.

The source or the drain of the second transistor Qd2, which is connected to the fourth switching transistor Q4, is connected to the drain or the source of the third transistor Qd3. The electrode of the second transistor Qd2, which is not connected to the drain or the source of the third transistor Qd3, is connected to the source or the drain of the sixth switching transistor Q6. The electrode of the sixth switching transistor Q6, which is not connected to the source or the drain of the second transistor Qd2, is connected to the electrode of the third transistor Qd3, which is not connected to the second transistor Qd2.

The electrode of the third transistor Qd3, which is connected to the source or the drain of the sixth switching transistor Q6, is connected to the drain or the source of the fourth transistor Qd4. The electrode of the third transistor Qd3, which is not connected to the drain or the source of the fourth transistor Qd4, is connected to the source or the drain of the fifth switching transistor Q5. The electrode of the fifth switching transistor Q5, which is not connected to the source or the drain of the third transistor Qd3, is connected to the electrode of the fourth transistor Qd4, which is not connected to the third transistor Qd3.

The source or the drain of the fourth transistor Qd4, which is connected to the source or the drain of the fifth switching transistor Q5, is connected to the source of the fifth transistor Qd5. The electrode of the fourth transistor Qd4, which is not connected to the drain or the source of the fifth switching transistor Q5, is connected to the source or the drain of the seventh switching transistor Q7. The electrode of the seventh switching transistor Q7, which is not connected to the fourth transistor Qd4, is connected to the drain of the fifth transistor Qd5. The drain of the fifth transistor Qd5 is connected to the drain of the first switching transistor Q1. The source of the first switching transistor Q1 is connected to the data line Xm, which is electrically connected to the data line driving circuit 14.

Furthermore, the respective gates of the fourth to seventh switching transistors Q4 to Q7 are mutually connected and they are connected to a third sub-scanning line Yn3 in common.

Also, the first to fifth transistors Qd1 to Qd5 and the fourth to seventh switching transistors Q4 to Q7 constitute the current control circuit unit 60.

Furthermore, the respective gates of the first to fifth transistors Qd1 to Qd5 constituting the current control circuit unit 60 are mutually connected in common and they are connected to the storage capacitor Cn and the drain of the second switching transistor Q2. The electrode of the storage capacitor Cn, which is not connected to the respective gates of the first to fifth transistors Qd1 to Qd5, is connected to the power source line VL. Furthermore, the source of the second switching transistor Q2 is connected to the drain of the first switching transistor Q1 and the drain of the third switching transistor Q3, respectively. The gate of the second switching transistor Q2 and the gate of the first switching transistor Q1 are mutually connected in common, and they are connected to the first sub-scanning line Yn1. The gate of the third switching transistor Q3 is connected to the second sub-scanning line Yn2. The source of the third switching transistor Q3 is connected to the anode of the organic EL element 21. The cathode of the organic EL element 21 is grounded.

Next, the operation of the pixel circuit 50 including the current control circuit unit 60 will be described.

The current control circuit unit 60 constituting the pixel circuit 50 is set to vary the resultant gain factor βo by controlling the respective on/off state of the fourth to seventh switching transistors Q4 to Q7 in accordance with a third scanning signal SC3 supplied from the scanning line driving circuit 13. Specifically, when the current control circuit unit 60 supplies the data current Idata to the pixel circuit 50, the third scanning signal SC3, for switching on the fourth to seventh switching transistors Q4 to Q7, is supplied to the respective gates of the fourth to seventh switching transistors Q4 to Q7 from the scanning line driving circuit 13. By doing so, the fourth to seventh transistors Q4 to Q7 are switched on, respectively.

At that time, the first to fifth transistors Qd1 to Qd5, constituting the current control circuit unit 60, are mutually connected in parallel. The resultant gain factor βpo of the current control circuit unit 60 in which the first to fifth transistors Qd1 to Qd5 are mutually connected in parallel is expressed as follows, using the gain factor βd of the first to fifth transistors Q1 to Q5.

$$\beta po=5\beta d$$

Furthermore, when the current control circuit unit 60 generates the driving current Ie1, the third scanning signal SC3 for switching off the fourth to seventh switching transistors Q4 to Q7 is supplied to the respective gates of the fourth to seventh switching transistors Q4 to Q7 from the scanning line driving circuit 13. By doing so, the fourth to seventh transistors Q4 to Q7 are switched off, respectively.

At that time, the first to fifth transistors Qd1 to Qd5 constituting the current control circuit unit 60 are mutually connected in series. The resultant gain factor βpo of the current control circuit unit 60 in which the first to fifth transistors Qd1 to Qd5 are mutually connected in series is expressed as follows, using the gain factor βd of the first to fifth transistors Q1 to Q5.

$$\beta po=\beta d/5$$

Therefore, using the resultant gain factor βpo when the first to fifth transistors Qd1 to Qd5 are mutually connected in parallel and the resultant gain factor βso when the first to fifth transistors Qd1 to Qd5 are mutually connected in series, the ratio of the data current Idata to the driving current Ie1 is expressed as the following equation.

$$\begin{aligned} Idata : Iel &= \beta po : \beta so \\ &= 5\beta d : \beta d/5 \\ &= 5 : 1/5 \end{aligned}$$

Therefore, the data current Idata is expressed as the following equation.

$$Idata=25Ie1$$

Therefore, the pixel circuit 50 of this exemplary embodiment can be supplied with the data current Idata having a current level twenty five times greater than the current level of the driving current Ie1. That is, since the current level of the data current Idata is twenty five times higher than the current level of the driving current Ie1, the data current Idatam can be written into the storage capacitor Cn at a correspondingly higher speed. Furthermore, since the writing of data to storage capacitor Cn is carried out using the data current Idata which is a current signal, it is possible to suppress the unevenness in characteristics such as threshold voltages of the first to fifth transistors Qd1 to Qd5 for every pixel circuits 50.

Next, the occupied area of the overall transistors provided in the pixel circuit 50 including the current control circuit unit 60 is calculated.

If the respective occupied areas of the first to fifth transistors Qd1 to Qd5 are denoted as SQd1 to SQd5 and the respective occupied areas of the first to seventh switching transistors Q1 to Q7 are denoted as SQ1 to SQ7, the occupied area St of the overall transistors in the pixel circuit 50 is expressed as follows.

$$St=SQd1+SQd2+SQd3+SQd4+SQd5+SQ1+SQ2+SQ3+SQ4+SQ5+SQ6+SQ7$$

Here, since the gain factors βd of the first to fifth transistors Qd1 to Qd5 are the same value, the occupied areas SQd1 to SQd5 of the first to fifth transistors Qd1 to Qd5 are the same value. Further, since the first to seventh switching transistors Q1 to Q7 are transistors functioning as switching elements, it is supposed that the occupied areas thereof are the same value.

Therefore, if the occupied area of the first to fifth transistors Qd1 to Qd5 is denoted as SQd and the occupied area of the first to seventh switching transistors Q1 to Q7 is denoted as SQo, respectively, the occupied area St of the overall transistors provided in the pixel circuit 50 is as follows.

$$\begin{aligned} St &= SQd1 + SQd2 + SQd3 + SQd4 + SQd5 + SQ1 + SQ2 + \\ &\quad SQ3 + SQ4 + SQ5 + SQ6 + SQ7 \\ &= 5SQd + 7SQo \end{aligned}$$

Here, it is supposed that the occupied area SQt of the first to seventh switching transistors Q1 to Q7 is equal to the occupied area SQd of the first to fifth transistors Qd1 to Qd5. Then, if the occupied areas of the first to fifth transistors Qd1 to Qd5 are denoted as SQo, the occupied area St of the overall transistors provided in the pixel circuit 50 is expressed as follows.

$$\begin{aligned} St &= 5SQd + 7SQo \\ &= 12SQd \end{aligned}$$

Therefore, advantages similar to those of the first exemplary embodiment can be obtained from the pixel circuit 50 including the current control circuit unit 60.

Next, a method of driving the pixel circuit 50 including the current control circuit unit 60 will be described with reference to FIGS. 6 to 8. FIG. 6 is a timing chart of the first, second and third scanning signals SC1, SC2, SC3 supplied to the first, second and third switching transistors Q1, Q2, Q3, and the driving current Ie1 flowing in the organic EL element 21.

First, for the predetermined data-writing period T1, the first scanning signal SC1 for switching on the first and second switching transistors Q1, Q2 is supplied through the first sub-scanning line Yn1 from the scanning line driving circuit 13. Further, at that time, the second scanning signal SC2 for switching off the third switching transistor Q3 is supplied through the second sub-scanning line Yn2 from the scanning line driving circuit 13. Furthermore, the third scanning signal SC3 for switching on the fourth to seventh switching transistors Q4 to Q7 is supplied through the third sub-scanning line Yn3 from the scanning line driving circuit 13.

When the first scanning signal SC1 for switching on the first and second switching transistors Q1, Q2 is supplied, the first and second switching transistors Q1, Q2 are switched on, respectively. Further, when the second scanning signal SC2 for switching off the third switching transistor Q3 is supplied, the third switching transistor Q3 is switched off. Furthermore, when the third scanning signal SC3 for switching on the fourth to seventh switching transistors Q4 to Q7 is supplied, the fourth to seventh switching transistors Q4 to Q7 are switched on.

FIG. 7 is an equivalent circuit schematic of the pixel circuit 50 for the data-writing period T1. For the data-writing period T1, the data current Idata from the data line driving circuit 14 is supplied to the pixel circuit 50 through the data line Xm. Then, a quantity of electric charge corresponding to the data current Idata is stored in the storage capacitor Cn. At that time, the first to fifth transistors Qd1 to Qd5 constituting the current control circuit unit 60 in the pixel circuit 50 are mutually connected in parallel as shown in FIG. 7. The resultant gain factor βpo of the current control circuit unit 60 in which the first to fifth transistors Qd1 to Qd5 are mutually connected in parallel is 5βd. The electric charges for maintaining this state are stored in the storage capacitor Cn.

Next, for the predetermined light-emitting period T2, the first scanning signal SC1 for switching off the first and second switching transistors Q1, Q2 is supplied through the first sub-scanning line Yn1 from the scanning line driving circuit 13. Further, at that time, the second scanning signal SC2 for switching on the third switching transistor Q3 is supplied through the second sub-scanning line Yn2 from the scanning line driving circuit 13. Furthermore, the third scanning signal SC3 for switching off the fourth to seventh switching transistors Q4 to Q7 is supplied through the third sub-scanning line Yn3 from the scanning line driving circuit 13.

When the first scanning signal SC1 for switching off the first and second switching transistors Q1, Q2 is supplied, the first and second switching transistors Q1, Q2 are switched off, respectively. Further, when the second scanning signal SC2 for switching on the third switching transistor Q3 is supplied, the third switching transistor Q3 are switched on. Furthermore, when the third scanning signal SC3 for switching off the fourth to seventh switching transistors Q4 to Q7 is supplied, the fourth to seventh switching transistors Q4 to Q7 are switched off.

FIG. 8 is an equivalent circuit schematic of the pixel circuit 50 for the light-emitting period T2. In the current control circuit unit 60 for the light-emitting period T2, the first to fifth transistors Qd1 to Qd5 constituting the current control circuit unit 60 are mutually connected in series. The resultant gain factor βso of the current control circuit unit 60 in which the first to fifth transistors Qd1 to Qd5 are mutually connected in series is βd/5.

Also, the pixel circuit 50 generates the driving current Ie1 from the first to fifth transistors Qd1 to Qd5 mutually connected in series, on the basis of the voltage corresponding to a quantity of electric charge corresponding to the data current Idata stored in the storage capacitor Cn. Then, by supplying the driving current Ie1 to the organic EL element 21, the very organic EL element 21 emits light in accordance with the current level of the driving current Ie1.

As a result, advantages similar to those of the first exemplary embodiment can also be obtained from the pixel circuit 50 having the current control circuit unit 60.

Third Exemplary Embodiment

Next, applications of the organic EL display device 10 as the electro-optical device described in the first and second exemplary embodiments to electronic apparatuses will be described with reference to FIGS. 9 and 10. The organic EL display device 10 can be applied to various electronic apparatuses such as mobile personal computers, mobile phones, or digital cameras.

Figure 9:
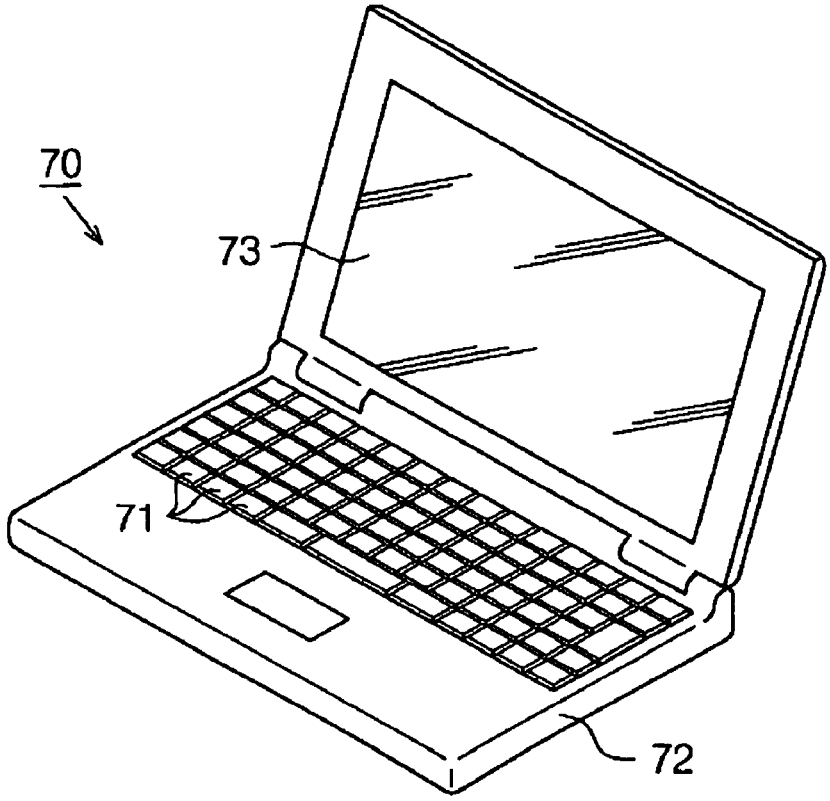
FIG. 9 is a perspective view illustrating a configuration of a mobile personal computer for the purpose of explanation of a third exemplary embodiment.

FIG. 9 is a perspective view illustrating a configuration of a mobile personal computer. In FIG. 9, the personal computer 70 includes a main body 72 having a keyboard 71, and a display unit 73 employing the organic EL display device 10.

In this case, the display unit 73 employing the organic EL display device 10 has advantages similar to those of the aforementioned exemplary embodiments.

Figure 10:
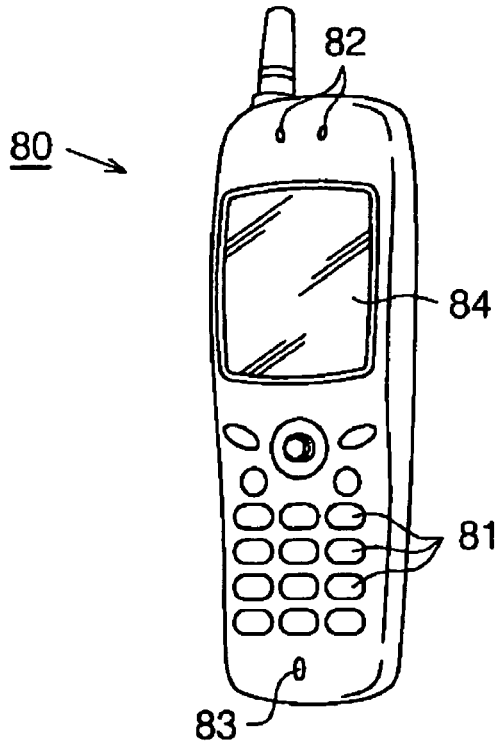
FIG. 10 is a perspective view illustrating a configuration of a mobile phone for the purpose of explanation of the third exemplary embodiment.

FIG. 10 is a perspective view illustrating a configuration of a mobile phone. In FIG. 10, the mobile phone 80 includes a plurality of manipulation buttons 81, an earpiece 82, a mouthpiece 83, and a display unit 84 employing the organic EL display device 10. Further, in this case, the display unit 84 employing the organic EL display device 10 has advantages similar to those of the aforementioned exemplary embodiments.

Further, the present invention is not limited to the exemplary embodiments described above, but may be implemented as follows.

In the aforementioned exemplary embodiments, the five driving transistors Qs, constituting the driving current generation circuit unit 30, are mutually connected in series, and the five current supply transistors Qp, constituting the current supply circuit unit 40, are mutually connected in parallel. As a result, since the data current Idata having the current level higher than that of the driving current Ie1 is supplied to the pixel circuit 20, the writing time to the storage capacitor Cn is shortened. Instead, the five driving transistors Qs, constituting the driving current generation circuit unit 30, may be mutually connected in parallel, and the five current supply transistors Qp, constituting the current supply circuit unit 40, may be mutually connected in series. By doing so, it is possible to implement an electronic device having an amplification function of generating the driving current Le1 having a higher current level on the basis of the data current Idata having a small current level. According to this construction, for example, the data current Idata having a higher current level can be supplied to the pixel circuit 20. As a result, the aforementioned electronic device can be applied to a memory such as MRAM (magneto-resistive element), a detecting device such as a photo-detector, or the like, in addition to the organic EL display device 10.

In the above exemplary embodiments, the driving current generation circuit unit 30 includes the five driving transistors Qs. Further, the current supply circuit unit 40 includes the five current supply transistors Qp. Instead, the driving current generation circuit unit 30 may include five or more, or five or less driving transistors Qs. Further, the current supply circuit unit 40 may include five or more, or five or less current supply transistors Qp. By doing so, without reducing the aperture ratio in comparison with the conventional pixel circuit, the data current Idata having the quantity of current larger than the quantity of current of the driving current Ie1 can be supplied to the pixel circuit 20.

Even when the polarity of the respective transistors is changed in the first and second exemplary embodiments, the similar advantages can be obtained.

Although the organic EL elements 21 are used as the electronic elements in the above exemplary embodiments, any electronic elements, other than the organic EL elements, may be used. For example, electro-optical elements or light emitting elements such as LEDs or FEDs may be used.

Although the organic EL display device 10 using the pixel circuit 20 having the organic EL elements 21 is used as the electronic device in the above exemplary embodiments, a display device using a pixel circuit having inorganic EL elements light emitting layers of which are made of inorganic materials may be used.

Although the organic EL display device 10 in which the pixel circuits 20, 50 having the organic EL elements 21 of only one color are provided is described in the above exemplary embodiments, the present invention may be applied to the organic EL display device in which the pixel circuits 20, 50 for the respective colors are provided in the three-color organic EL elements 21 of red, green and blue.

What is claimed is:

1. An electronic circuit, comprising:

a first circuit unit including a plurality of transistors through which a first current having a first current level passes;

a switching element mutually connected to the plurality of transistors in the first circuit unit;

a capacitor element to store a quantity of electric charge corresponding to the first current level; and a second circuit unit including a plurality of transistors to generate a second current having a second current level different from the first current level on the basis of the quantity of electric charge stored in the capacitor element, respective gates of the plurality of transistors in the first circuit unit being mutually connected to respective gates of the plurality of transistors in the second circuit unit, the plurality of transistors in the first circuit unit and the plurality of transistors in the second circuit unit having the same driving capability, the first circuit unit and the second circuit unit constituting a current mirror circuit through the capacitor element by turning on the switching element, and the plurality of transistors in the first circuit unit are connected in one of series or parallel and the plurality of transistors in the second circuit unit are connected in the other one of series or parallel.

2. The electronic circuit according to claim 1, the plurality of transistors in the first circuit unit being connected in parallel, and the plurality of transistors in the second circuit unit being connected in series.

3. The electronic circuit according to claim 1, the plurality of transistors in the first circuit unit being connected in series, and the plurality of transistors in the second circuit unit being connected in parallel.

4. The electronic circuit according to claim 1, the plurality of transistors being formed in a bundle.

5. The electronic circuit according to claim 1, the first current level being higher than the second current level.

6. The electronic circuit according to claim 1, the second current level being higher than the first current level.

7. The electronic circuit according to claim 1, further comprising:

electronic elements supplied with the second current.

8. The electronic circuit according to claim 7, the electronic elements being electro-optical elements or current-driven elements.

9. The electronic circuit according to claim 8, the electronic elements being organic EL elements.

10. An electronic apparatus having mounted therein the electronic circuit according to claim 1.

11. An electronic device provided with a first signal line, a second signal line, and a plurality of unit circuits, each of the plurality of unit circuits comprising:

a switching element connected to the first signal line, an on/off state of the switching element being controlled by switching signals supplied from the first signal line;

a first circuit unit including a plurality of transistors connected to the second signal line, a first current having a first current level supplied from the second signal line passing through the first circuit unit by switching on the switching element;

a capacitor element to store a quantity of electric charge corresponding to the first current level; and a second circuit unit including a plurality of transistors to generate a second current having a second current level different from the first current level on the basis of the quantity of electric charge stored in the capacitor element, the switching element mutually connected to a the plurality of transistors in the first circuit unit;

respective gates of the plurality of transistors in the first circuit unit being mutually connected to respective gates of the plurality of transistors in the second circuit unit, the plurality of transistors in the first circuit unit and the plurality of transistors in the second circuit unit having the same driving capability, the first circuit unit and the second circuit unit constituting a current mirror circuit through the capacitor element by turning on the switching element, and the plurality of transistors in the first circuit unit are connected in one of series or parallel and the plurality of transistors in the second circuit unit are connected in the other one of series or parallel.

12. The electronic device according to claim 11, the plurality of transistors in the first circuit unit being connected in parallel, and the plurality of transistors in the second circuit unit being connected in series.

13. The electronic device according to claim 11, the plurality of transistors in the first circuit unit being connected in series, and the plurality of transistors in the second circuit unit being connected in parallel.

14. The electronic device according to claim 11, the plurality of transistors being formed in a bundle.

15. The electronic device according to claim 11, the first current level being higher than the second current level.

16. The electronic device according to claim 11, the second current level being higher than the first current level.

17. The electronic device according to claim 11, further comprising:

electronic elements supplied with the second current.

18. The electronic device according to claim 17, the electronic elements being electro-optical elements or current-driven elements.

19. The electronic device according to claim 18, the electronic elements including organic EL elements.

20. An electronic apparatus having mounted therein the electronic device according to claim 11.

* * * * *